US009429064B2

(12) United States Patent
Nagahama et al.

(10) Patent No.: US 9,429,064 B2
(45) Date of Patent: Aug. 30, 2016

(54) COOLANT CONTROL VALVE APPARATUS

(71) Applicant: MIKUNI CORPORATION, Tokyo (JP)

(72) Inventors: Kenichiro Nagahama, Odawara (JP); Toru Tsuchiya, Odawara (JP); Takumi Oikawa, Odawara (JP); Masayuki Daikuhara, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 14/206,613

(22) Filed: Mar. 12, 2014

(65) Prior Publication Data

US 2014/0190427 A1 Jul. 10, 2014

Related U.S. Application Data

(63) Continuation of application No. PCT/JP2012/073267, filed on Sep. 12, 2012.

(30) Foreign Application Priority Data

Sep. 22, 2011 (JP) ..... 2011-207413

(51) Int. Cl.
*F01P 7/16* (2006.01)
*F01P 11/16* (2006.01)

(52) U.S. Cl.
CPC ..... *F01P 7/16* (2013.01); *F01P 11/16* (2013.01); *F01P 2031/00* (2013.01); *F01P 2060/16* (2013.01); *F01P 2070/02* (2013.01)

(58) Field of Classification Search
CPC ..... F01P 7/16; F01P 2007/146; Y10T 137/87788
USPC ..... 123/41.08–41.1, 41.15, 198 D
See application file for complete search history.

(56) References Cited

U.S. PATENT DOCUMENTS 4,964,371 A * 10/1990 Maeda et al. ..... 123/41.1
5,979,373 A 11/1999 Sano (Continued)

FOREIGN PATENT DOCUMENTS

EP 0890717 A 1/1999
EP 1108867 A 6/2001

(Continued)

OTHER PUBLICATIONS

International Search Report, dated Dec. 18, 2012, issued in corresponding application No. PCT/JP2012/073267.

(Continued)

*Primary Examiner* — Hung Q Nguyen
*Assistant Examiner* — Kevin Lathers
(74) *Attorney, Agent, or Firm* — Westerman, Hattori, Daniels & Adrian, LLP

(57) ABSTRACT

A coolant control valve apparatus 10 includes a main valve 11 which adjusts a flow rate of a coolant in a main channel 4 to control the flow rate of the coolant in the main channel 4. Further, the coolant control valve apparatus 10 includes a detour channel 67 provided being diverged from the main channel 4 so as to detour the main valve 11. The coolant control valve apparatus 10 includes a valve main body 41 which opens and closes the detour channel 67 and a temperature detection medium 42 which can open and close the valve main body 41 according to a temperature of the coolant. The temperature detection medium 42 is disposed in the diverging part between the detour channel 67 and the bypass channel 5.

2 Claims, 5 Drawing Sheets

(56) References Cited

U.S. PATENT DOCUMENTS

| | | | | |
|---|---|---|---|---|
| 6,109,301 | A | 8/2000 | Pfetzer | |
| 6,371,060 | B1 | 4/2002 | Lehmann et al. | |
| 6,539,899 | B1 * | 4/2003 | Piccirilli et al. | 123/41.1 |
| 2001/0013553 | A1 | 8/2001 | Chamot et al. | |
| 2009/0065172 | A1 | 3/2009 | Vacca et al. | |

FOREIGN PATENT DOCUMENTS

| | | | |
|---|---|---|---|
| EP | 2354607 | A1 | 8/2011 |
| JP | 64-066413 | A | 3/1989 |
| JP | 01-106919 | A | 4/1989 |
| JP | 10-077841 | A | 3/1998 |
| JP | 10-089071 | A | 4/1998 |
| JP | 10-317967 | A | 12/1998 |
| JP | 2001-041039 | A | 2/2001 |
| JP | 2009-515106 | A | 4/2009 |
| JP | 2010-528229 | A | 8/2010 |
| WO | 03/042517 | A1 | 5/2003 |

OTHER PUBLICATIONS

Notice of Reason for Rejection dated Dec. 1, 2015, issued in counterpart Japanese Patent Application No. 2011-207413, with English translation (9 pages).

International Search Report dated Jun. 2, 2003, issued in Application No. PCT/DE02/04022, with English translation (6 pages).

Office Action dated Jan. 12, 2016, issued in counterpart European Patent Application No. 12833165.9-1606 (6 pages).

* cited by examiner

COOLANT CONTROL VALVE APPARATUS

TECHNICAL FIELD

The present invention relates to a coolant control valve apparatus that controls coolant when water-cooling an engine of a vehicle or the like.

BACKGROUND ART

With regard to an engine of a vehicle such as a car, improvement of a warm-up performance of the engine and improvement of a fuel efficiency by moving the engine at an appropriate temperature and the like have been examined. This was achieved by providing, besides a main passage which circulates coolant between the engine and a radiator, a bypass passage which bypasses the radiator and returns the coolant directly to the engine. A coolant control valve was provided in the main passage, and an opening degree of this coolant control valve was controlled according to a coolant temperature and other values. An amount of the coolant that is flowing in the main passage and cooled off by the radiator was also controlled. For example, at the engine starting or the like, when the coolant temperature is low, warm-up of the engine is promoted by blocking the main passage and returning the coolant from the bypass passage directly to the engine without allowing the coolant to pass through the radiator. Also, for example, for controlling the temperature of the coolant so as to optimize combustion of fuel in the engine after the warm-up, opening and closing (the opening degree) of the coolant control valve is controlled.

As such a coolant control valve, for example, a rotary valve that is driven by a stepping motor or the like, and a thermostatic valve that is moved according to a temperature are examined. Incidentally, as the thermostatic valve, a thermostat, a thermowax or the like that is displaced according to a temperature is adopted, and this displacement according to the temperature opens and closes the valve.

Herein, if, by any chance, the coolant control valve stops its operation in the closed state, the coolant is circulated in the engine via the bypass passage without being cooled off by the radiator, whereby the coolant temperature is increased. If the engine is operated as it is, the engine may become overheated. It has been suggested to circulate the coolant towards the radiator by a valve (other than the coolant control valve) which is provided in a thermal protection device that is operated when the temperature of the coolant is increased when the coolant control valve stops its operation in the closed state or the like (for example, see Patent Literature 1).

That is, the valve that is provided in the thermal protection device works as a fail-safe mechanism. Incidentally, the valve provided in the thermal protection device is a valve which adopts a device that is displaced according to a temperature, for example, a thermostat, a thermowax, shape-memory alloy, a combination of alloy that is melted at a preset temperature with a spring or the like. When the coolant temperature is increased to the preset temperature or higher, the device is displaced according to the temperature so as to open the valve.

CITATION LIST

Patent Literature

Patent Literature 1: JP 2010-528229 W

SUMMARY OF INVENTION

Technical Problem

In Patent Literature 1, when a main control valve is in a closed state, flow of coolant in a passage from an engine to a coolant control valve is stopped, and similarly, flow in a passage of a thermal protection device, diverging from the passage from the engine to a coolant control valve, is also stopped. Thus, a temperature gap is caused between a temperature of the coolant that is circulated in the engine and a temperature detected by the thermal protection device. That is, a long gap of time is caused from a time of increasing the temperature of the coolant in the engine to a time of increasing the temperature of the coolant in a part of the coolant control valve that is in the closed state. Thereby, there occurs a problem in that the temperature of the coolant in the engine cannot be detected appropriately by the thermal protection device.

Also, in the case where there occurs a malfunction in that the coolant control valve cannot be operated and stays in the closed state, the engine may become overheated. In such a situation, the coolant control valve closes the passage of the coolant between the radiator and the engine and the coolant that is flowing out of the engine passes through a bypass passage and then flows into the engine again.

Since the coolant control valve is in the closed state, the coolant is stopped in the part of the coolant control valve, and the temperature of the coolant that is stopped in the part of the coolant control valve is lower than the temperature of the coolant that is circulated in the engine. There is a long gap of time from when the temperature of the coolant in the engine is increased to the time the temperature of the coolant is increased in the part of the coolant control valve that is in the closed state. In the case where a fail-safe valve, provided in the part of the coolant control vale, is moved by the above-described device by displacement according to the temperature, the movement of the fail-safe valve is delayed from the temperature change of the coolant in the engine.

Moreover, if the fail-safe valve is to be controlled according to a temperature setting which includes, in advance, an expected temperature distribution of the coolant in the part of the coolant control valve and in the vicinity thereof so as not to delay the movement of the fail-safe valve, the fail-safe valve may be improperly opened when the fail-safe valve is normally operated because of the thus minimized gap between the control temperature of the coolant control valve and the temperature at which the fail-safe valve is to be opened. That is, if the coolant control valve is closed, the temperature change of the coolant in the part of the coolant control valve is delayed from that in the engine, and if the coolant control valve is opened, the temperature change of the coolant in the part of the coolant control valve is substantially equal to that in the engine. However, if the fail-safe valve is a thermostat type, since the preset temperature for opening and closing the valve cannot be controlled according to the situation, the fail-safe valve cannot sufficiently correspond to the temperature change of the coolant in the part of the coolant control valve according to the state where the coolant control valve is closed or opened.

The present invention is achieved in the light of the above-described problems, and aims to provide a coolant control valve apparatus including a valve that can be opened from a closed state, by appropriately detecting a coolant temperature in an engine while the coolant control valve is closed.

Solution to Problem

To achieve the above object, a coolant control valve apparatus of the present invention controls a flow rate of coolant in a main channel of an engine cooling system a main valve that controls the flow rate of coolant in a main channel of an engine cooling system circulating the coolant between an engine and a radiator; a detour channel diverging from the main channel as a detour for the coolant from the valve to flow away from the main channel; a secondary valve moved independently from the main valve to open and close the detour channel; and a temperature detection medium that drives movement of the secondary valve to open and close the detour channel, and can open and close the secondary valve according to a temperature of the coolant, wherein the temperature detection medium is disposed in a diverging part between the detour channel and a bypass channel of the engine cooling system directing the coolant leaving the engine to bypass the radiator and return to the engine.

In the present invention, by structuring the bypass channel to pass through the temperature detection medium, the temperature detection medium can appropriately detect the temperature of the coolant in the engine even while the valve is closed, and the valve can be opened. If there occurs malfunction to the valve, and the valve cannot be opened from the closed state, the coolant passes through the bypass channel and is not cooled off by the radiator, so that the temperature of the coolant is increased in the engine. Thereby, a temperature of the bypass channel is also increased substantially concurrently.

Herein, to the main channel, the detour channel that detours around the valve (main valve) of the coolant control valve apparatus and the bypass channel that bypasses the radiator are connected. The bypass channel is separated from the detour channel in a part where the detour channel is diverged from the main channel. Thus, the coolant flows at least from the part where the detour channel is diverged from the main channel above the valve to the part of the detour channel where the bypass channel is diverged. Since the temperature detection medium that opens and closes the valve main body according to the change of the temperature is provided in the diverging part between the detour channel and the bypass passage, even in the state where the valve is closed, the coolant that flows in the bypass channel passes through the part of the temperature detection medium.

Therefore, the temperature of the temperature detection medium is increased promptly corresponding to the temperature increase of the coolant in the engine due to the malfunction of the valve. And for example, the valve main body is opened so that the coolant flos into the main channel by detouring around the closed valve, thereby feeding the coolant into the radiator for cooling off. That is, the transmission of the heat caused by the temperature increase in the engine to the temperature detection medium can be prevented from being delayed. Accordingly, further increase of the temperature in the engine before the operation of the valve main body can be suppressed.

Thereby, even if the valve is not opened due to malfunction or the like, it is possible to feed the coolant through the main channel to the radiator by corresponding to the temperature increase of the coolant in the engine, so that the coolant temperature can be decreased. Thus, overheating of the engine can be prevented.

In the above structure of the present invention, it is preferable that the valve is a rotary valve provided with a rotor and includes a controlling means that controls a rotation angle of the rotor. The controlling means includes a power transmission mechanism having a gear train.

According to such a structure, by adopting the rotary-type valve, the flow rate can be adjusted according to the rotation angle of the rotor. Moreover, in order to set the flow rate to be constant or stop the flow, the rotation angle of the rotor is to be maintained. Further, by adopting a gear train as a power transmission mechanism, the rotor can be held at a constant rotation angle. Thus, electric power is not necessary for maintaining the rotation angle of the rotor.

In addition, since the gear train is adopted as the power transmission mechanism, the flow rate can be adjusted by such a simple structure.

Further, in the above structure of the present invention, it is preferable that the temperature detection medium is an on-off valve that opens the valve main body from a closed state according to a change of a detected temperature, and a preset temperature for opening the on-off valve is higher than a preset temperature range for opening the valve.

According to such a structure, in the case of setting the coolant at a high temperature, the coolant temperature can be adjusted by closing the coolant valve and using the temperature detection medium.

Further, in the above structure of the present invention, it is preferable that the temperature detection medium and the valve main body are fail-safe valves that are opened from a closed state according to a change of a detected temperature, and are opened when the temperature of the coolant becomes a predetermined temperature or higher.

According to such a structure, the temperature detection medium and the valve main body are the fail-safe valves, which are operated when the main valve is not operated in the closed state as described above, so that the temperature increase in the engine can be prevented. Thereby, the malfunction caused by the temperature increase in the engine can be prevented.

Further, in the above structure of the present invention, it is preferable that the engine cooling system includes at least one sub channel that circulates the coolant between the engine and a device requiring circulation of the coolant, such as a heater, and the valve can control a flow rate of the coolant in the sub channel.

According to such a structure, the flow rates of the coolant in the plurality of sub channels can be controlled by the one valve, so that cost savings and size reduction can be achieved more than those in a case of adopting a plurality of such valves. Moreover, for controlling to open and close the plurality of channels, for example, the above-described rotary valve is preferably adopted.

Advantageous Effects of Invention

According to the present invention, the coolant control valve apparatus can appropriately detect the temperature of the coolant in the engine, and can open the valve even while the coolant control valve is closed.

Moreover, since the temperature can be detected more appropriately by the temperature detection medium, in the case where the coolant is desired to be set at a high temperature, the temperature can be adjusted also by the temperature detection medium with its opening temperature set to be high. Further, if the valve cannot be opened due to malfunction, since the temperature detection medium of the fail-safe valve detects the temperature increase of the coolant and opens the valve, the valve main body of the fail-safe valve is opened without being delayed from the temperature increase of the coolant, so that the coolant can be feed into the radiator to be cooled off. Therefore, the temperature increase of the coolant due to the malfunction of the valve can be prevented, and the malfunction of the engine or the like caused by the temperature increase can also be prevented.

DESCRIPTION OF EMBODIMENTS

Hereinafter, an embodiment of the present invention will be described with reference to the accompanying drawings.

Figure 1:
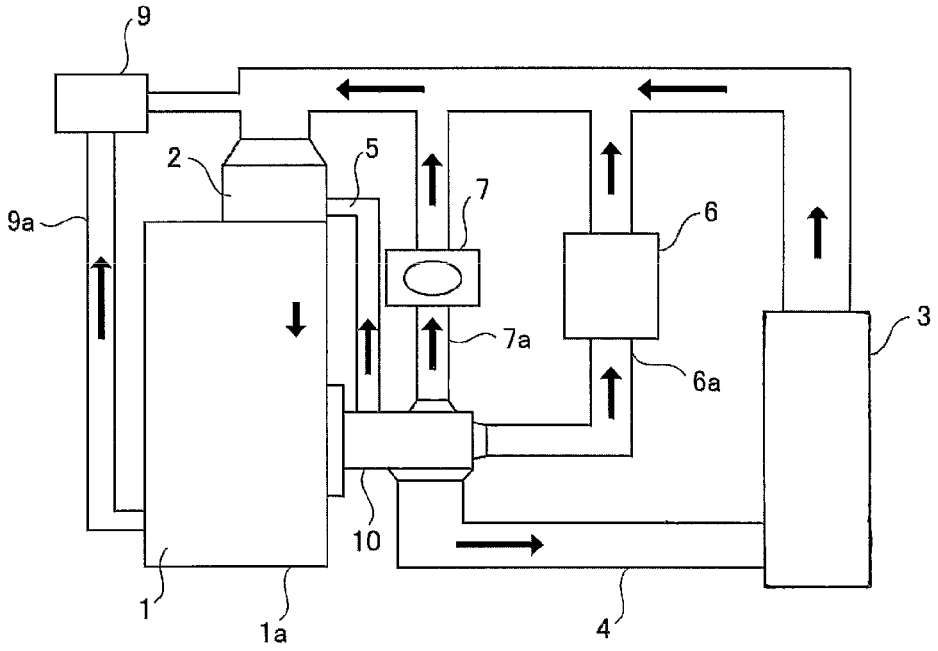
FIG. 1 is a cooling circuit diagram illustrating an outline of an engine cooling system that adopts the coolant control valve apparatus of an embodiment of the present invention.
Figure 2:
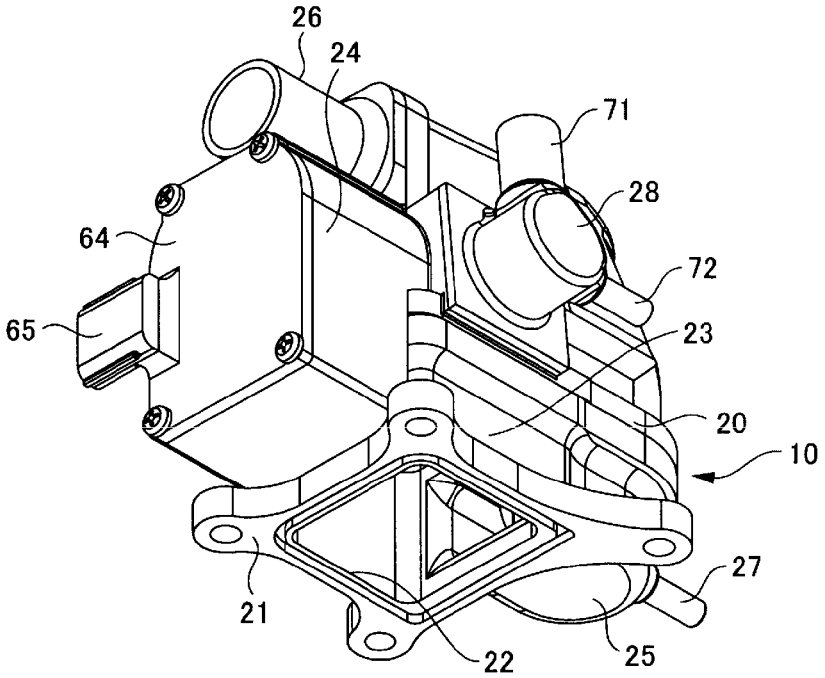
FIG. 2 is a perspective view that illustrates the coolant control valve apparatus.
Figure 3:
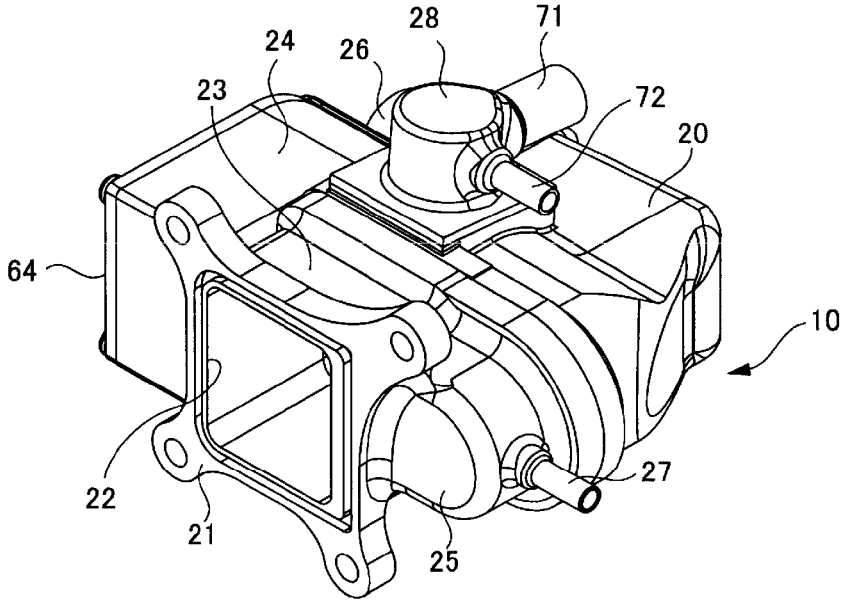
FIG. 3 is a perspective view that illustrates the coolant control valve apparatus.
Figure 4:
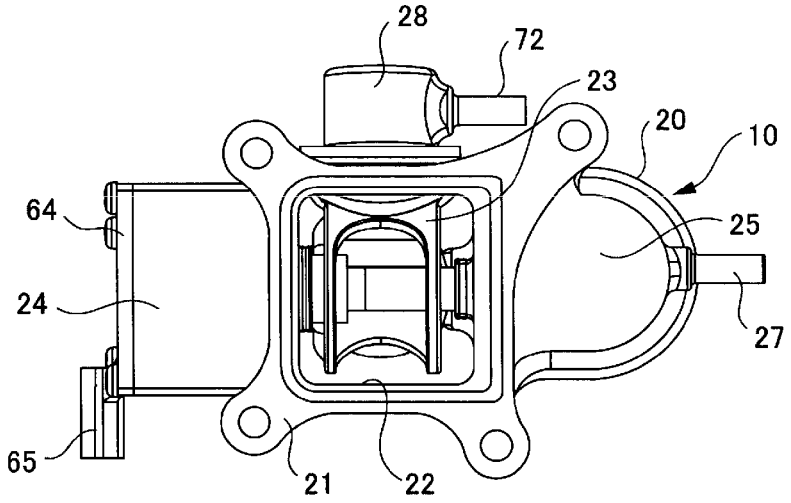
FIG. 4 is a perspective view that illustrates the coolant control valve apparatus.
Figure 5:
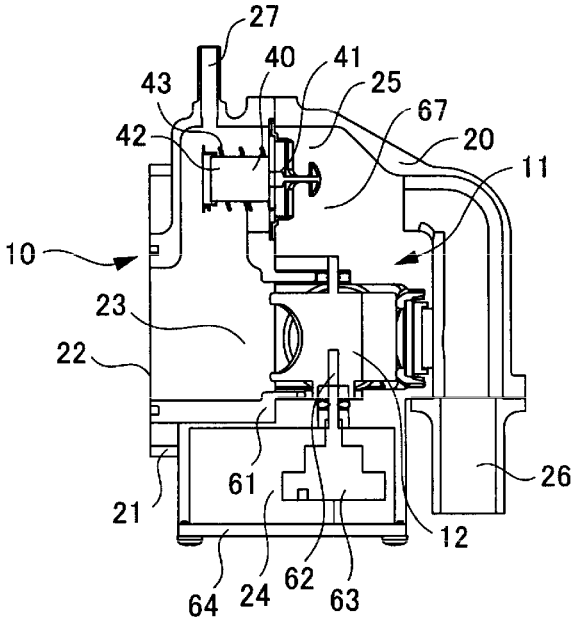
FIG. 5 is a cross-sectional view that illustrates the coolant control valve apparatus.
Figure 6:
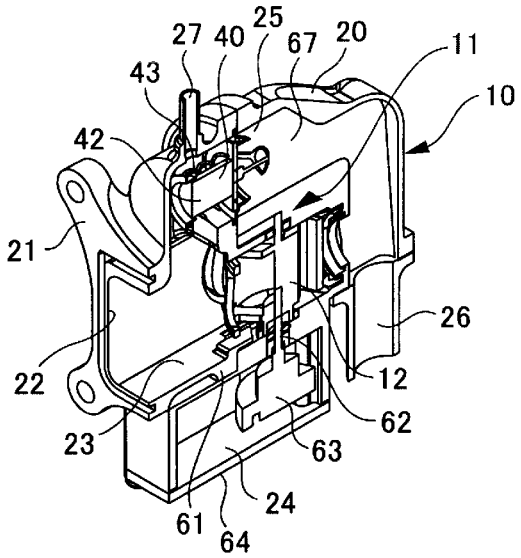
FIG. 6 is a perspective cross-sectional view that illustrates the coolant control valve apparatus.
Figure 7:
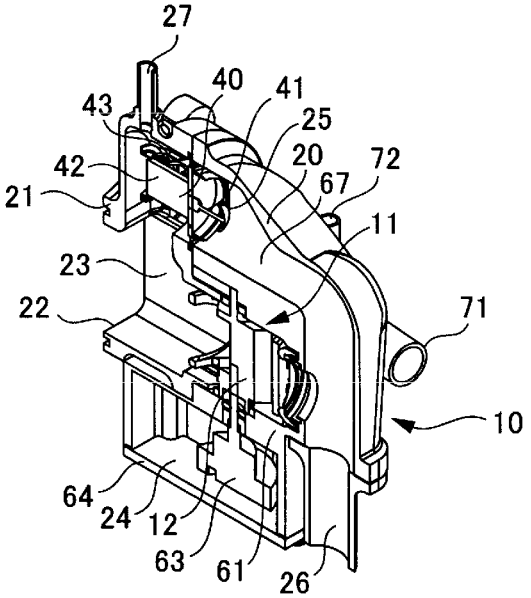
FIG. 7 is a perspective cross-sectional view that illustrates the coolant control valve apparatus.
Figure 8:
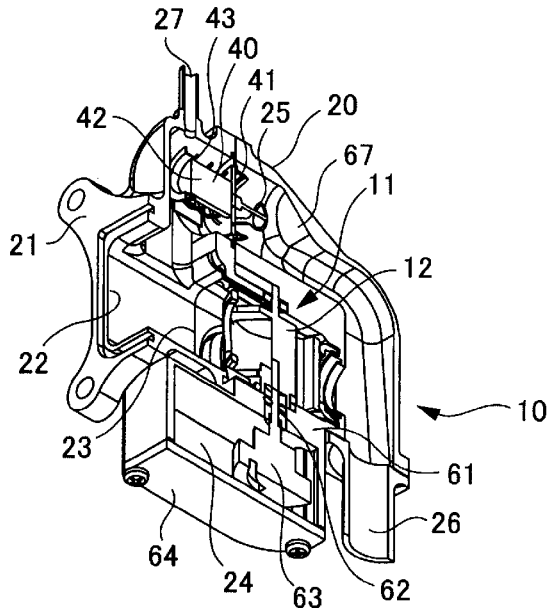
FIG. 8 is a perspective cross-sectional view that illustrates the coolant control valve apparatus.
Figure 9:
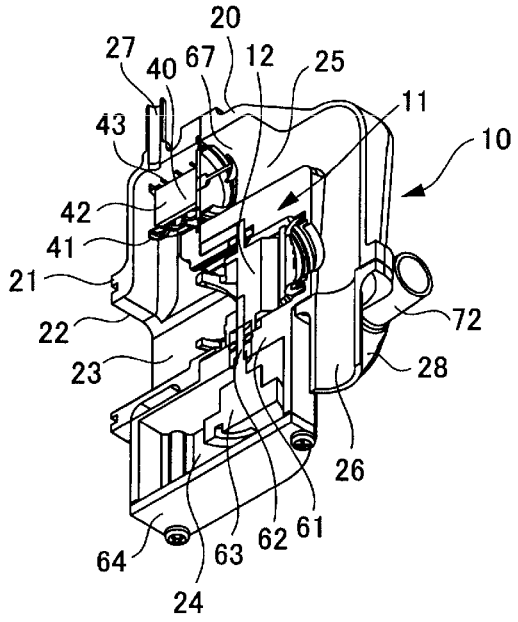
FIG. 9 is a perspective cross-sectional view that illustrates the coolant control valve apparatus.

As illustrated in FIG. 1, an engine cooling system that adopts a coolant control valve apparatus 10 of this embodiment includes: the coolant control valve apparatus 10 that is provided communicating with a water jacket 1*a* of an engine 1; a water pump 2 that is provided communicating with the water jacket 1*a* so as to circulate coolant; a radiator 3 for cooling off the coolant; a main channel 4 for circulating the water from the water jacket 1*a* through the coolant control valve apparatus 10, the radiator 3, and the water pump to return the water to the water jacket 1*a* again.

Moreover, in the engine cooling system, the bypass channel 5 is provided to bypass the radiator 3, that is, the bypass channel 5 is disposed from the coolant control valve apparatus 10 to the water pump 2 without passing through the radiator 3. Even when the coolant control valve apparatus 10 closes the main channel 4, the water from the water jacket 1*a* can be circulated by the water pump 2 to pass through the bypass channel 5. Incidentally, the water pump 2 is driven by driving force of the engine 1.

Thereby, in the case where a coolant temperature is low at engine starting or the like, by closing the main channel 4 in the coolant control valve apparatus 10, the coolant is heated by the heat of the engine 1 without being cooled off by the radiator 3.

Moreover, between the coolant control valve apparatus 10 and the water pump 2, a sub channel 6*a* and a sub channel 7*a* are provided, in addition to the main channel 4 and the bypass channel 5. The sub channel 6*a* passes through the heater 6. The sub channel 7*a* passes through a throttle 7 (a water jacket for a throttle). Incidentally, each of the channels is formed by a pipe, for example.

Also, in a vehicle, exhaust gas recirculation (EGR) may be performed. The EGR is a technique for refluxing a part of exhaust gas to an inlet side so as to allow an engine to breathe the exhaust gas again, whereby a concentration of nitrogen oxide and the like can be reduced.

The EGR valve 9 is for controlling a volume of exhaust gas that is refluxed to the inlet side, and is cooled off by the coolant of the engine. In this embodiment, the water pump 2 and an EGR cooling channel 9*a* that is connected to the water jacket 1*a* are connected to the EGR valve 9 for cooling off. In this embodiment, the EGR cooling channel 9*a* is structured not to pass through the coolant control valve apparatus 10, but may be structured to pass through the coolant control valve apparatus 10.

Moreover, the coolant control valve apparatus 10 is provided with a rotary main valve 11, and according to a rotation angle of a rotor 12 of this main valve 11, flow rates in the main channel 4 and the two sub channels 6*a* and 7*a* can be changed (the channels can be opened and closed). Further, according to the rotation angle of the rotor 12, for example, while the main channel 4 is in an opened state, the sub channel 6*a* for the heater 6 can be opened and closed, and an opening degree thereof can be changed. For example, within a range of the rotation angle of the rotor 12 that can maintain the main channel 4 to be in the opened state, a rotation angle that can change the opening degree of the sub channel 6*a* from the closed state to the opened state is included.

For example, the rotor 12 is provided with an opening part that is in communication with the main channel 4 and is long in a circumferential direction. In the state where the coolant can pass through the opening, the rotor 12 can be rotated from a state where the opening for the sub channel 6*a* is in communication with the sub channel 6*a* to a state where the opening is not in communication with the sub channel 6*a*. Incidentally, the rotor 12 may be provided with a plurality of the openings for the main channel 4 to be arranged in the circumferential direction.

Thereby, the above-described structure can realize a state where the main channel 4 is opened, and the sub channel 6*a* may be opened or closed.

As illustrated in FIGS. 2 to 9, the coolant control valve apparatus 10 of this embodiment includes a casing 20 that is attached to circumference of an opening part, which is not illustrated, of the water jacket 1*a* of the engine 1. The casing 20 includes: a flange part 21 having an opening 22 in a center part thereof to be in communication with the opening part of the water jacket 1*a*; a principal chamber 23 which has an inner space to be in communication with the opening 22 of the flange part 21 and in which the main valve 11 having the rotor 12 is disposed; a driving chamber 24 in which a driving means that drives to rotate the rotor 12 is disposed; an auxiliary chamber 25 which is in communication with the principal chamber 23 and in which a fail-safe valve (FS valve) 40 is disposed; a main discharge part 26 which is in communication with the principal chamber 23 and the auxiliary chamber 25, and is connected to the main channel 4; a bypass discharge part 27 which is in communication with the auxiliary chamber 25, and is connected to the bypass channel 5 in a state of being diverged from the auxiliary chamber 25; and a sub discharge part 28 that is connected to the sub channels 6*a* and 7*a*.

In a center of the flange part 21, the rectangular opening 22 is formed, and the flange part 21 is shaped so that four corner parts of the opening 22 are outwardly extended, and these extended parts are provided with through holes for bolts that fix the flange part 21 to the water jacket 1*a*. Each of the openings 22 is in communication with the inside of the water jacket 1*a* of the engine 1 as described above, and serves as an admission port of the coolant control valve apparatus 10.

Further, at a circumference of the opening 22 in the flange part 21, a groove for sealant to be inserted is formed around the opening 22.

The principal chamber 23 includes an inner space which is provided from the opening 22 of the flange part 21 to a base of the main discharge part 26 that is provided on an opposite side of the opening 22 in the casing 20, and in this inner space, the main valve 11 that includes the rotor 12 is disposed. The rotor 12 is disposed so as to divide the inner space into the opening 22 side, the main discharge part 26 side, and the sub discharge part 28 side. The rotor 12 includes a plurality of openings and an inner space that is in communication with the openings. The rotation angle of the rotor 12 can switch between: an opened state where the opening 22 side and the main discharge part 26 side are in communication with each other; and a closed state where the opening 22 side and the main discharge part 26 side are not in communication with each other. An opening degree thereof can be adjusted according to the rotation angle of the rotor 12.

At the same time, the rotation angle of the rotor 12 can also switch between an opened state where the opening 22 side and the sub discharge part 28 side are in communication with each other and a closed state where the opening 22 side and the sub discharge part 28 side are not in communication with each other. An opening degree thereof can be adjusted according to the rotation angle of the rotor 12.

Incidentally, only one rotor 12 is provided, but as described above, according to the arrangement of the opening that is provided to the rotor 12, a state where the main channel 4 is opened and the sub channel 6*a* is opened or closed can also be realized. The main valve 11 includes: the rotor 12; and a rotor containing part which has an inner peripheral surface that is in contact with the outer peripheral surface of the rotor 12. The rotor containing part also has openings in the inner peripheral surface, where the openings correspond to the respective openings of the rotor 12 and correspond also to the main channel 4, the sub channel 6*a*, and the sub channel 7*a*. This main valve 11 opens and closes the main channel 4, and also opens and closes the sub channel 6*a* and the sub channel 7*a*.

The driving chamber 24 is isolated by an isolation wall 61 that is disposed between the driving chamber 24 and the principal chamber 23. A rotation axis 62 for rotating the rotor 12 penetrates the isolation wall 61 and is connected to the rotor 12 so as to drive to rotate the rotor 12. In the driving chamber 24, a gear 63 that is provided together with the rotation axis 62 and is rotated around the rotation axis 62 as a rotation center. A gear attached to a motor that can control its rotation angle (a servomotor, a stepping motor or the like), which is not illustrated, is engaged with the gear 63 directly or indirectly via another gear so as to rotate the gear 63. That is, a gear train as a power transmission mechanism is arranged between the rotor 12 and the motor. The rotor 12 is driven to be rotated by the motor via the gear train. Since the gear train that is connected to the gear for driving the motor restrains the rotation of the rotor 12, electric power or the like is not necessary to maintain the rotation angle of the rotor 12.

The motor is controlled by a controlling device (a controlling means) which is not illustrated. Its rotation angle is controlled, for example, by a coolant temperature that is detected by a sensor and is input into the controlling device, or by a room temperature in a vehicle which is related to the heater 6 or the like. Incidentally, the communication between the opening 22 and the main discharge part 26 comes into the opened state to cool off the coolant by the radiator 3 basically when the coolant temperature reaches a preset temperature or higher. It comes into the closed state when the temperature of the coolant is lower than the preset temperature. But, while being in the opened state, the flow rate of the coolant is also controlled according to the coolant temperature or the like.

Moreover, the driving mechanism for the rotor 12, such as the motor and the gear 63, is arranged so as to be stored in the driving chamber 24. In the driving chamber 24, a cover 64 that can be opened and closed is fastened by a screw. A terminal part 65 that is provided with a terminal of a wiring for transmission of electric power to the motor and transmission of a control signal is disposed on this cover.

The auxiliary chamber 25 is structured to be in communication with the principal chamber 23 at the opening 22 side of the flange part 21 (the engine 1 side) with respect to the rotor 12, and also to be in communication with the main discharge part 26, whereby the opening 22 and the main discharge part 26 are in communication with each other. Thus, the principal chamber 23 opens and closes the communication between the opening 22 and the main discharge part 26 by the main valve 11 that is provided with the rotor 12. And on the other hand, the auxiliary chamber 25 detours around the main valve 11 so that the opening (admission port) 22 which is in communication with the inside of the water jacket 1*a* of the engine 1 and the main discharge part (exhaust port) 26 may be in communication with each other.

This auxiliary chamber 25 serves as a detour channel 67 that allows the admission port and the exhaust port of the coolant control valve apparatus 10 to be in communication with each other by detouring around the main valve 11.

The FS valve 40 is disposed in the auxiliary chamber 25 that serves as this detour channel 67, and opens and closes the detour channel 67 by which the opening 22 side and the main discharge part 26 are in communication with each other. The FS valve 40 is provided with: a valve main body 41 (a secondary valve) that opens and closes the detour channel 67; a temperature detection medium 42 that includes this valve main body 41 and drives to open and close the valve main body 41 according to a temperature change; and a returning spring 43 that energizes the valve main body 41 toward the open side.

As the temperature detection medium 42, for example, a thermowax, is used, and also, a thermostat, shape-memory alloy and the like can be adopted, as far as they can open and close the valve at a preset temperature by their displacement according to the temperature. When the temperature becomes higher than the preset temperature (range), the temperature detection medium 42 opens the valve main body 41 so that the opening 22 and the main discharge part 26 may be in communication with each other. When the temperature becomes lower than the preset temperature (range), the temperature detection medium 42 closes the valve main body 41 so as to shield between the opening 22 and the main discharge part 26. Incidentally, in the temperature detection medium 42, the thermowax is stored inside a case, and a known mechanism for driving the valve main body 41 corresponding to expansion and contraction of the thermowax is incorporated.

Incidentally, the preset temperature of the FS valve 40 is higher than the above-described preset temperature of the main valve 11 for opening and closing the communication between the opening 22 and the main discharge part 26. The temperature detection medium 42 operates to open the valve main body 41 of the FS valve 40 when the temperature becomes higher than the preset temperature at which the main valve 11 opens the communication between the opening 22 and the main discharge part 26.

The returning spring 43 energizes the valve main body 41 toward the open side. If, for example, the temperature detection medium 42 is broken and the valve main body 41 becomes in a state where it can be opened and closed freely, the returning spring 43 opens the valve main body 41. Thereby, even when the FS valve 40 is not operated, if the valve main body 41 is in a state where it can be opened and closed freely, the valve main body 41 can be opened.

Further, in the auxiliary chamber 25, the bypass discharge part 27 that is connected to the bypass channel 5 is provided communicating with the inside of the auxiliary chamber 25. Thus, the actual bypass channel 5 extends from the opening 22 of the flange part 21 of the casing 20 in the coolant control valve apparatus 10, passes through the part of the principal chamber 23 at the opening 22 side with respect to the rotor 12, reaches the auxiliary chamber 25 of the casing 20, and is connected to a tube that is not illustrated and constitutes a main part of the bypass channel 5 from the bypass discharge part 27, whereby the coolant is sucked by the water pump 2 from the bypass channel 5.

Therefore, inside the casing 20 of the coolant control valve apparatus 10, the bypass channel 5 is provided being diverged from the principal chamber 23 that is a part of the main channel 4, and the detour channel 67 of the auxiliary chamber 25 is disposed in the part where the bypass channel 5 is diverged from the main channel 4, and then, the temperature detection medium 42 of the FS valve 40 is disposed in the part that is to be the bypass channel 5.

Thereby, even when the main valve 11 is closed, and the coolant is not flowing in the main channel 4, the coolant that is flowing in the bypass channel 5 is regularly in contact with the temperature detection medium 42, so that the coolant which is just flowing out of the water jacket 1*a* of the engine 1 and has a temperature substantially equal to a temperature inside the water jacket 1*a* is in contact with the temperature detection medium 42, regardless of whether the main valve 11 is opened or closed.

Thus, since the temperature detection medium 42 is regularly in contact with the coolant whose temperature is substantially equal to the temperature inside the water jacket 1*a*, when the temperature of the coolant inside the water jacket 1*a* is increased to the preset temperature or higher, at which the temperature detection medium 42 opens the valve main body 41 from the closed state, the temperature of the temperature detection medium 42 is also increased to the preset temperature or higher by the coolant flowing toward the bypass channel 5, whereby the valve main body 41 can be opened. Also, in the case where the coolant temperature is decreased, the temperature of the temperature detection medium 42 is similarly decreased to the preset temperature or lower by the coolant flowing toward the bypass channel 5, whereby the valve main body 41 is closed.

Incidentally, according to the conventional structure, in the case of disposing the FS valve having the temperature detection medium into the coolant control valve apparatus, when the coolant control valve apparatus is in the closed state, all of the coolant in the coolant control valve apparatus is not flowing and is stopped. Thus, the temperature is not transmitted by the flow of the coolant, and heat is transmitted via the casing of the coolant control valve apparatus which is fixed to the water jacket 1*a* and by the coolant that is not flowing therein. Then, the FS valve 40 is operated according to this transmitted heat, so that the operation of the FS valve 40 is delayed from the change of the coolant temperature inside the water jacket 1*a*.

On the other hand, according to this embodiment, the temperature of the coolant inside the water jacket 1*a* is transmitted swiftly to the temperature detection medium 42 of the FS valve 40 by the coolant that is flowing out of the water jacket 1*a* toward the bypass channel 5, whereby the FS valve 40 can be operated swiftly corresponding to the temperature change of the coolant inside the water jacket 1*a*.

The main discharge part 26 is in communication with the principal chamber 23 which is a part of the main channel 4 as described above and is opened and closed by the main valve 11 having the rotor 12, and also, is in communication with the auxiliary chamber 25 which is in communication with the detour channel 67 and is opened and closed by the FS valve 40, thereby discharging the coolant that is flowing out of the water jacket 1*a* via the principal chamber 23 and/or the auxiliary chamber 25 to a tube that constitutes the main channel 4.

Moreover, the sub discharge part 28 is provided at a position corresponding to the rotor 12 (the main valve 11) in the principal chamber 23, and discharge pipes 71 and 72 are opened and closed respectively, according to positional relationships between: openings for the respective discharge pipes 71 and 72 which are formed in an isolation wall between the principal chamber 23 and the sub discharge part 28; and an opening for the sub discharge part 28 which is formed in the rotor 12 of the main valve 11.

In such a coolant control valve apparatus 10, even in a state where, since the main valve 11 is closed, the coolant is not basically flowing in the coolant control valve apparatus 10, the coolant is regularly flowing in the part of the temperature detection medium 42 due to the bypass channel 5 that is diverged at the part of the temperature detection medium 42 of the FS valve 40 as described above, and the coolant temperature inside the water jacket 1*a* of the engine 1 is transmitted swiftly by this coolant, whereby the FS valve 40 can be opened and closed corresponding to the change of the coolant temperature inside the water jacket.

That is, if, although the coolant temperature inside the water jacket 1*a* reaches the preset temperature at which the main valve 11 opens the main channel 4, the main channel 4 is not opened due to malfunction of the main valve 11. And further, the coolant temperature inside the water jacket 1*a* is increased to reach the preset temperature for opening the FS valve 40 The FS valve 40 becomes opened in a short period of time, whereby the temperature control of the coolant inside the water jacket can be stable.

Incidentally, in the above-described embodiment, only the main valve 11 normally controls the flow rate of the coolant in the main channel 4. But, in addition to the main valve 11, the FS valve 40 may be normally used for controlling the flow rate. For example, an upper limitation may be added to the preset temperature for opening the main valve 11, and the main valve 11 may be closed when the coolant temperature reaches the upper limitation of the preset temperature. And further, the FS valve 40 may be opened at a temperature that is substantially equal to this upper limitation of the preset temperature.

Incidentally, the control of the timing for switching between the main valve 11 and the FS valve 40 can be set freely, so that, for example, the opening degree of the main valve 11 may be decreased at a temperature before reaching the upper limitation of the preset temperature, and the FS valve 40 may be opened at this temperature.

In this case, the flow rate of the coolant at lower temperatures is controlled by the main valve 11, and the flow rate at higher temperatures is controlled by the FS valve. Basically, while the temperature of the coolant is low, for example, at engine starting or the like, the flow rate of the coolant is controlled by opening and closing the main valve 11. And while the temperature of the coolant in the engine is higher than the preset temperature, for example, during travelling, the main valve 11 is held closed, and the FS valve 40 is opened and closed according to the change of the temperature detection medium 42 by the temperature so as to control the flow rate of the coolant, thereby controlling the coolant temperature. For example, when the coolant temperature is decreased due to a change of an outside air temperature, a change in travelling speed (including an idling time, while the speed is zero) or the like, the FS valve 40 is closed. At this time, the main valve 1 is maintained in a desired state of closing. In this case, after the period of engine starting while the coolant temperature is low, the main valve 11 is maintained closing the main channel 4, but the sub channels 6*a* and 7*a* are opened and closed by the main valve 11. In the above-described case, the FS valve 40 functions as a valve for controlling the coolant temperature, and for example, in the coolant control valve apparatus 10, the main valve 11 functions as a valve for the low temperatures, and the FS valve 40 functions as a valve for the high temperatures.

As described above, by decreasing the working time of the main valve 11, the lifespan of the main valve 11 can be extended.

REFERENCE SIGNS LIST

1 engine
3 radiator
4 main channel
5 bypass channel
6 heater
6*a* sub channel
7 throttle
7*a* sub channel
10 coolant control valve apparatus
11 main valves (valve)
12 rotor
40 fail-safe valve
41 valve main body
42 temperature detection medium
67 detour channel

The invention claimed is:

1. A coolant control valve apparatus comprising:

a main valve that controls the flow rate of coolant in a main channel of an engine cooling system circulating the coolant between an engine and a radiator;

a detour channel diverging from the main channel as a detour for the coolant from the valve to flow away from the main channel;

a secondary valve moved independently from the main valve to open and close the detour channel; and a temperature detection medium that drives movement of the secondary valve to open and close the detour channel, and can open and close the secondary valve according to a temperature of the coolant, wherein the temperature detection medium is disposed in a diverging part between the detour channel and a bypass channel of the engine cooling system directing the coolant leaving the engine to bypass the radiator and return to the engine, wherein the coolant is regularly flown out of the engine, and the temperature detection medium is in the bypass channel, wherein the coolant that is flown in the bypass channel is regularly in contact with the temperature detection medium, wherein the main valve is a rotary valve provided with a rotor and includes a controlling means that controls a rotation angle of the rotor, wherein the controlling means includes a power transmission mechanism having a gear train, and wherein the secondary valve is a fail-safe valve that is driven by the temperature detection medium to be opened from a closed state according to a change of a detected temperature, and to be opened when the temperature of the coolant becomes a predetermined temperature or higher.

2. The coolant control valve apparatus according to claim 1, wherein the engine cooling system includes at least one sub channel that circulates the coolant between the engine and a device requiring circulation of the coolant and the main valve can control a flow rate of the coolant in the sub channel.

* * * * *